US008056748B2

(12) United States Patent
Chen

(10) Patent No.: US 8,056,748 B2
(45) Date of Patent: Nov. 15, 2011

(54) SAFE DEVICE HAVING DUAL CAPS FOR A SQUEEZABLE CONTAINER

(76) Inventor: Fang-Pin Chen, Chia Yi Hsien (TW)

( * ) Notice: Subject to any disclaimer, the term of this patent is extended or adjusted under 35 U.S.C. 154(b) by 975 days.

(21) Appl. No.: 12/014,474

(22) Filed: Jan. 15, 2008

(65) Prior Publication Data

US 2009/0179031 A1 Jul. 16, 2009

(51) Int. Cl.

| | |
|---|---|
| ***B65D 51/18*** | (2006.01) |
| ***B65D 43/18*** | (2006.01) |
| ***B65D 17/44*** | (2006.01) |
| ***B65D 25/26*** | (2006.01) |
| ***B65D 41/04*** | (2006.01) |
| *B65D 35/56* | (2006.01) |
| *B67D 1/00* | (2006.01) |

(52) U.S. Cl. ..... 220/254.1; 220/255; 220/278; 220/259.2; 220/259.3; 220/259.4; 220/636; 220/916; 215/334; 222/105; 222/83; 222/568

(58) Field of Classification Search ..... 220/254.1, 220/916, 625, 669, 278, 277, 255, 258.1, 220/258.3, 254.3, 254.2, 254.4, 254.6, 254.7, 220/254.8, 259.1, 259.2, 259.3, 259.4; 222/105, 222/88, 83, 83.5, 89, 91, 541.2, 81, 568; 215/334, 330, 331, 46, 201, 204, 217–221; 604/411–413

See application file for complete search history.

(56) References Cited

U.S. PATENT DOCUMENTS

| | | | | |
|---|---|---|---|---|
| 5,799,829 | A * | 9/1998 | Lier et al. | 222/83 |
| 5,934,457 | A * | 8/1999 | Ueda et al. | 206/204 |
| 6,315,165 | B1 * | 11/2001 | Regan | 222/103 |
| 6,725,060 | B1 * | 4/2004 | Chhatriwala et al. | 455/556.2 |

* cited by examiner

*Primary Examiner* — Robin Hylton
(74) *Attorney, Agent, or Firm* — Stites & Harbison PLLC; Marvin Petry

(57) ABSTRACT

A safe device for a squeezable container includes a protective cover, a body, and a bottom cap. The protective cover includes an idle cap, an inner cap, and a mouthpiece. The idle cap is rotatably mounted around the inner cap. The body includes a compartment for receiving a squeezable container. A plurality of non-return blocks are formed on an outer periphery defining an upper opening of the body and meshable with non-return blocks on the mouthpiece to prevent the mouthpiece from disengaging from the container. The bottom cap is engaged in and seals a lower opening of the body. A rotational force applied to the idle cap can only be transmitted to the inner cap when a force greater than a predetermined magnitude is applied to move the idle cap downward to tightly engage with the outer periphery of the inner cap.

4 Claims, 4 Drawing Sheets

SAFE DEVICE HAVING DUAL CAPS FOR A SQUEEZABLE CONTAINER

BACKGROUND OF THE INVENTION

The present invention relates to a safe device for a container and, more particularly, to a safe device for a squeezable container receiving adhesive or the like.

A typical tube of adhesive is shown in FIG. 6 and includes a body 1' for receiving liquid adhesive. The body 1' can be tubular or of other shapes. Formed on an end of the body 1' are a neck 11', a throat 12', and a mouth 13' that is sealed by a film 15' that can be pierced. The other end 14' of the body 1' is open and can be sealed by folding or other conventional methods to a line. Since the end 14' is rectilinear, the tube can not stand in an upright position with the end 14' at the bottom. Namely, the tube is often placed flatly on a surface after being squeezed for dispensing adhesive such that the adhesive may flow outward from the mouth 13', which is particularly true for a tube made of soft metal such as aluminum alloy. To avoid leakage, a mouthpiece 21' having inner threading 211' threadedly engaged with outer threading 16' on the throat 12' and a cap 2' having inner threading 20' threadedly engaged with outer threading on the mouthpiece 21' are provided to seal the mouth 13'. The cap 2' includes a needle 22' for piercing the film 15' to allow outflow of the liquid adhesive in the body 1'. However, the threading engagement between the cap 2' and the mouthpiece 21' and between the mouthpiece 21' and the mouth 13' are liable to be disengaged by children. As a result, the children may be injured or eat the adhesive.

A need exists for a safe device preventing children from accessing the tube of adhesive.

BRIEF SUMMARY OF THE INVENTION

A safe device for a squeezable container according to the preferred teachings of the present invention includes a protective cover, a body, and a bottom cap. The protective cover includes an idle cap, an inner cap, and a mouthpiece. The idle cap includes upper and lower openings and a compartment having upper and lower ends respectively in communication with the upper and lower openings of the idle cap. The inner cap includes a compartment with inner threading. The inner cap includes an engaging portion extending upward from a top end thereof and rotatably extending through the upper opening of the idle cap. The mouthpiece includes inner threading, plurality of first non-return blocks, and a channel. The mouth piece further includes a pointed mouth and a piercing portion having a bottom hole. The channel includes upper and lower ends respectively in communication with the pointed mouth and the bottom hole of the piercing portion. The mouthpiece further includes outer threading threadedly engaged with the inner threading of the inner cap. The body includes upper and lower openings and a compartment adapted for receiving a squeezable container. The compartment of the body includes upper and lower ends respectively in communication with the upper and lower openings of the body. A plurality of non-return blocks are formed on an outer periphery defining the upper opening of the body and meshable with the non-return blocks of the mouthpiece. The bottom cap includes a plate having a size and an area the same as those of the lower opening of the body. The plate is engaged in the lower opening of the body.

Rotation of the mouthpiece relative to the body in a direction is allowed. The non-return blocks of the mouthpiece are stopped by the non-stop blocks of the body when rotated in a reverse direction. Thus, the mouthpiece can not be disengaged from the container. A rotational force applied to the idle cap can only be transmitted to the inner cap when a force greater than a predetermined magnitude is applied to move the idle cap downward to tightly engage with the outer periphery of the inner cap, and such a magnitude of force is beyond a child's ability. As a result, opening of the idle cap by the child is avoided. Namely, the child can only rotate the idle cap freely. Injury to the child is avoided.

The present invention will become clearer in light of the following detailed description of an illustrative embodiment of this invention described in connection with the drawings.

DETAILED DESCRIPTION OF THE INVENTION

Figure 1:
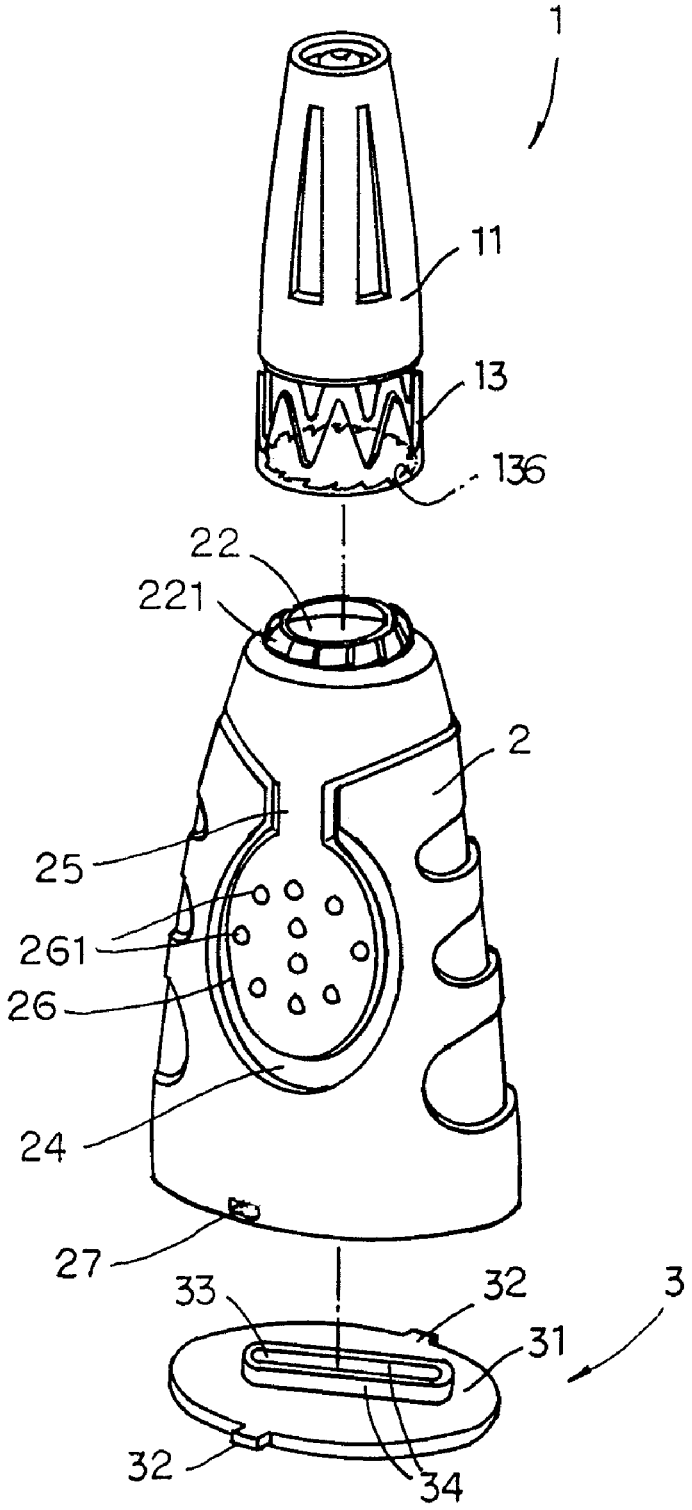
FIG. 1 shows a diagrammatic exploded, perspective view of a safe device for a squeezable container according to the preferred teachings of the present invention.
Figure 2:
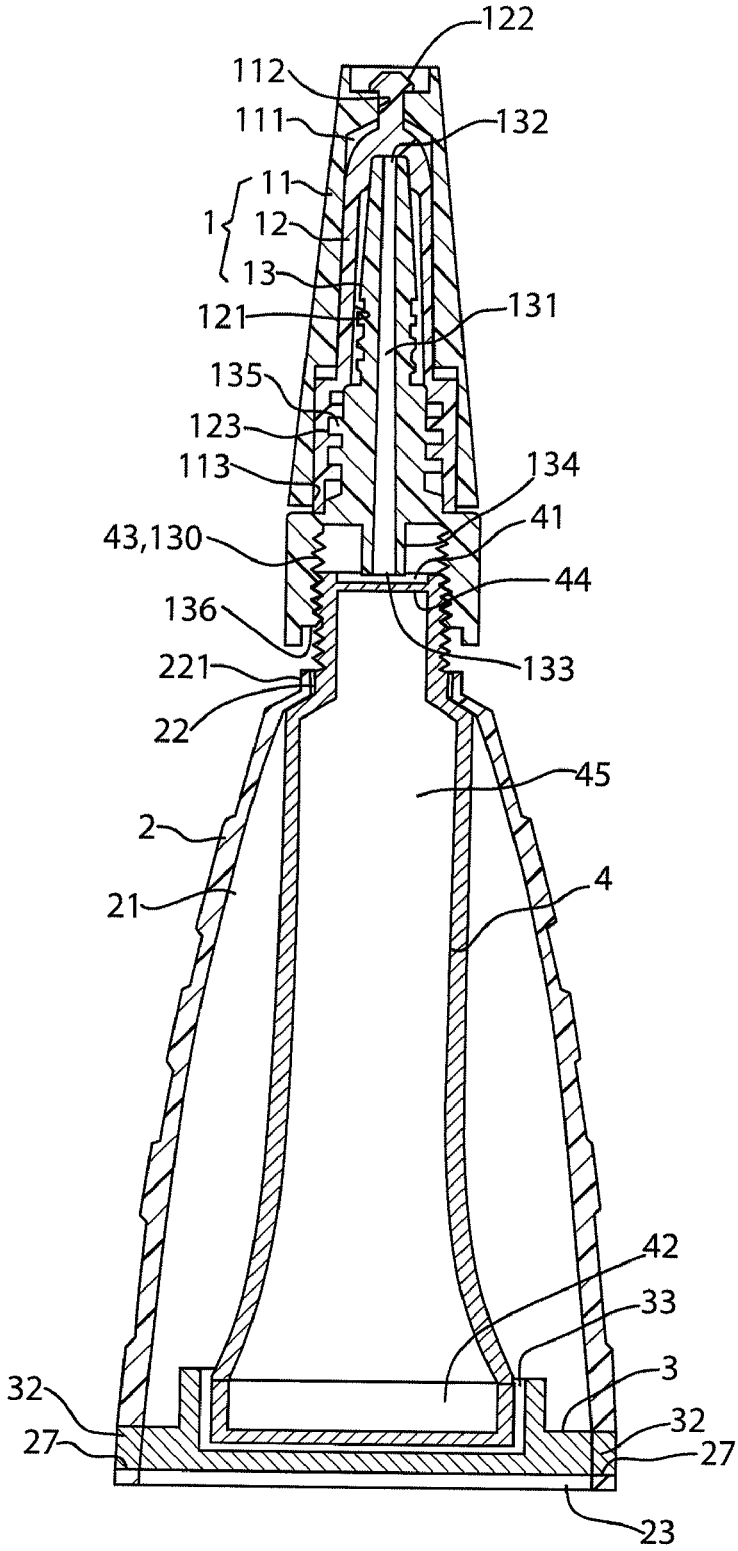
FIG. 2 shows a cross sectional view of the safe device of FIG. 1 and a squeezable container.
Figure 3:
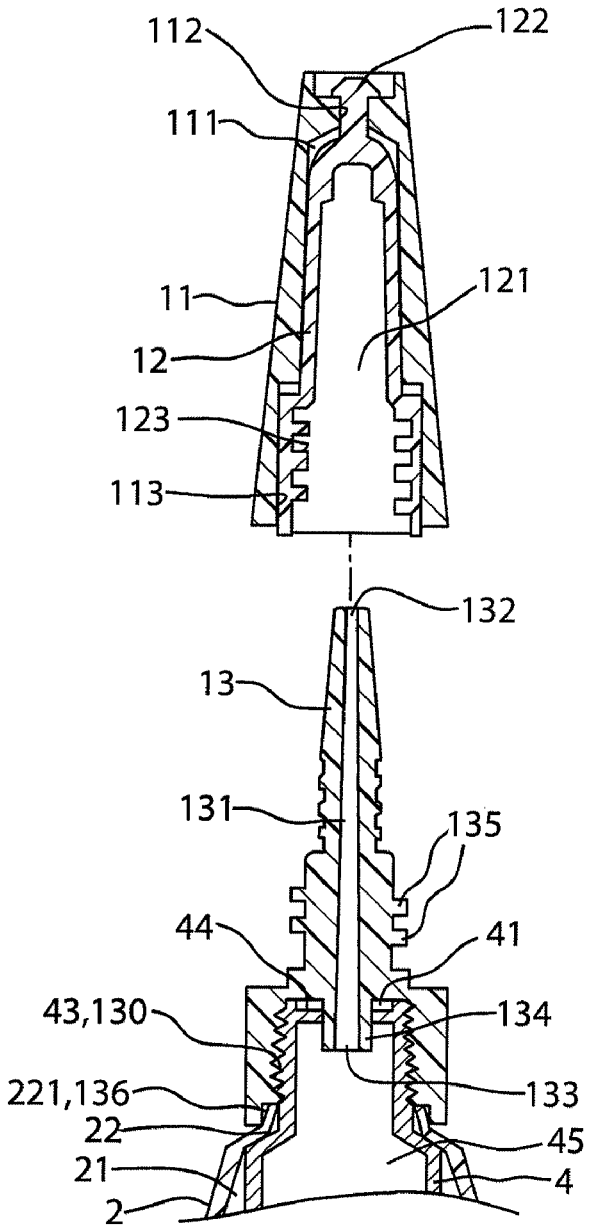
FIG. 3 shows a partial, exploded, cross sectional view of the safe device and the squeezable container of FIG. 2 with a cap of the safe device removed and with an inner cap of the safe device rotated to allow use of the squeezable container.
Figure 6:
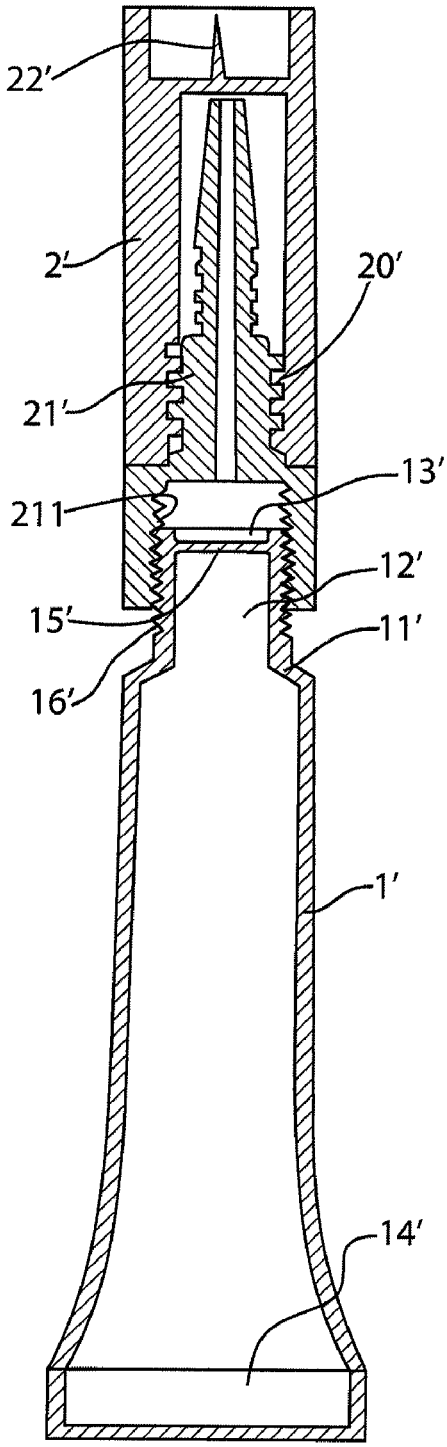
FIG. 6 PRIOR ART
FIG. 6 shows a cross sectional view of a tube of adhesive, a mouthpiece, and a cap according to prior art.

With reference to FIG. 1, a safe device according to the preferred teachings of the present invention generally includes a protective cover 1, a body 2, and a bottom cap 3. The protective cover 1 includes an idle cap 11, an inner cap 12, and a mouthpiece 13. With reference to FIGS. 2 and 3, the idle cap 11 is made of plastic material such as plastics and includes a compartment 111 having an upper end and a lower end respectively in communication with an upper opening 112 and a lower opening 113. The inner cap 12 is also made of plastic material such as plastics and includes a compartment 121 with inner threading 123 on an inner periphery defining the compartment 121. A mushroom engaging portion 122 protrudes upward from a top end of the inner cap 12. The inner cap 12 can be mounted through the lower opening 113 into the idle cap 11, with the engaging portion 122 extending through the upper opening 112 of the idle cap 12 such that the idle cap 11 is freely rotatable relative to the inner cap 12 due to rotatable coupling of the engaging portion 122 in the upper opening 112. However, when a force greater than a predetermined magnitude is applied to move the idle cap 11 downward to tightly engage with an outer periphery of the inner cap 12, the rotational force applied to the idle cap 11 can be transmitted to and, thus, rotate of the inner cap 12. The mouthpiece 13 is also made of plastic material such as plastics. The mouth piece 13 includes inner threading 130, a plurality of sloping non-return bocks 136 on an outer periphery thereof, and a channel 131. The channel 131 includes an upper end in communication with a pointed mouth 132 at an outer end of the mouth piece 13 and a lower end in communication with a bottom hole 133 of a piercing portion 134 at an inner end of the mouth piece 13. The mouthpiece 13 further includes outer threading 135 threadedly engaged with the inner threading 123 of the inner cap 12.

The body 2 is made of plastic material such as plastics and includes a compartment 21 having an upper end and a lower end respectively in communication with an upper opening 22 and a lower opening 23 of the body 2. A plurality of sloping non-return blocks 221 are formed on an outer periphery defining the upper opening 22. Two press portions 26 are respectively formed on two opposite sides of the body 2. Each press portion 26 is connected to an upper end of the body 2 by a connecting section 25 and surrounded by a peripheral groove 24. It can be appreciated that the connecting section 25 is not necessarily above the press portion 26. A lower end of each of the opposite sides of the body 2 includes a slot 27 in communication with the compartment 21 of the body 2. To avoid sliding while pressing the press portions 26, each press portion 26 has a plurality of protrusions 261 protruding outward from an outer face thereof. Thus, a user can squeeze the body 2 by pressing the press portions 26 with the thumb and the index finger of one of his or her hands. A squeezable container 4 such as a tube for receiving fluid such as adhesive is received in the compartment 21 and can be squeezed by pressing the press portions 26.

The bottom cap 3 includes a plate 31 having a size and an area the same as those of the lower opening 23 of the body 2. Each of two sides of the plate 31 includes an outwardly-protruding tab 32 that is engaged with one of the slots 27 when the bottom cap 3 is mounted to and, thus, seals the lower end of the body 2. To prevent the squeezable container 4 from sliding or shifting, the plate 31 includes a rectilinear groove 33. In the preferred form shown, the rectilinear groove 33 is formed between two parallel walls 34 on an upper side of the plate 31. It can be appreciated that two ends of the parallel walls 34 can be connected and sealed by two end walls while providing the same function.

Figure 4:
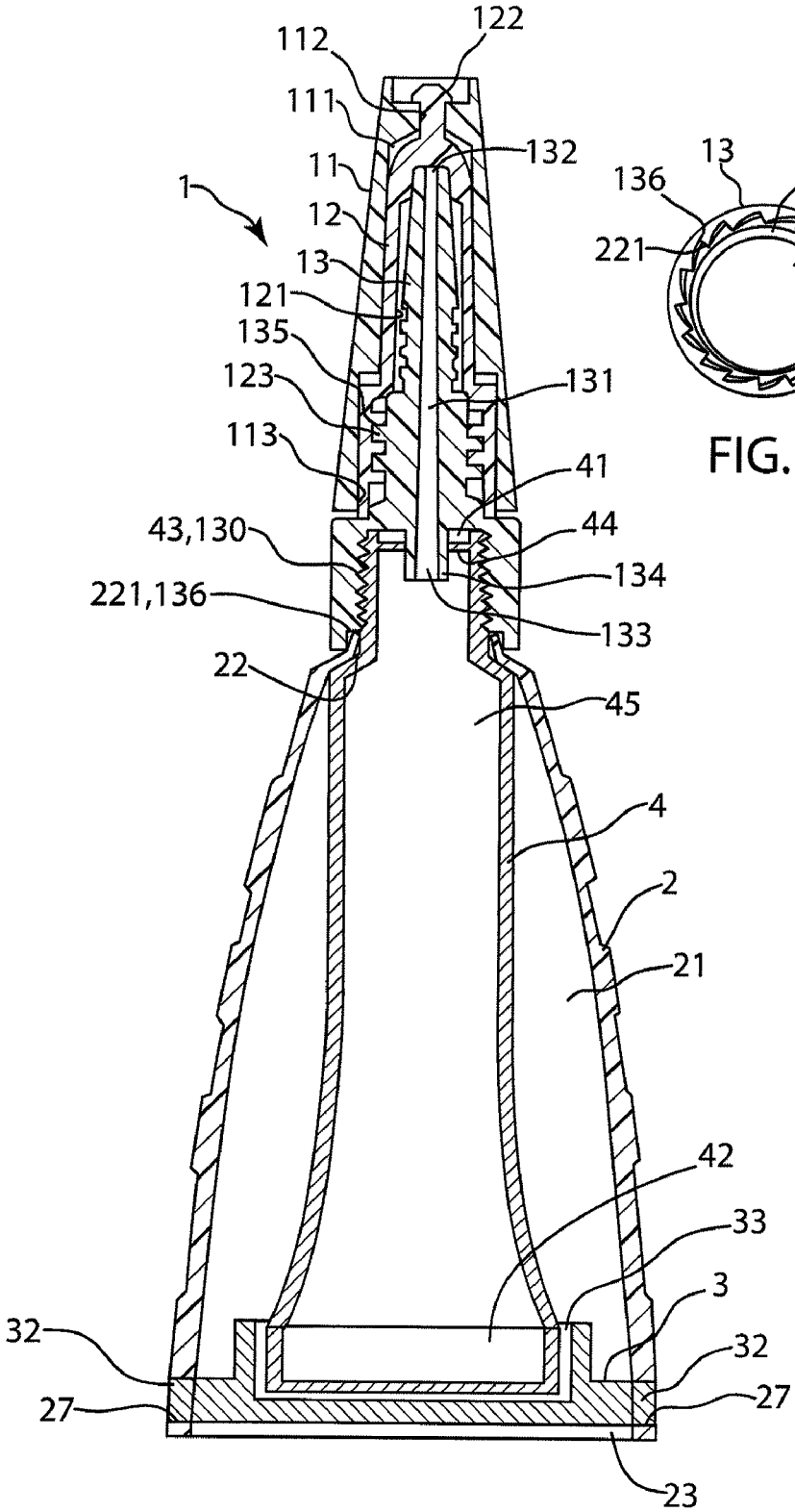
FIG. 4 is a cross sectional illustrating use of the safe device according to the preferred teachings of the present invention.
Figure 5:
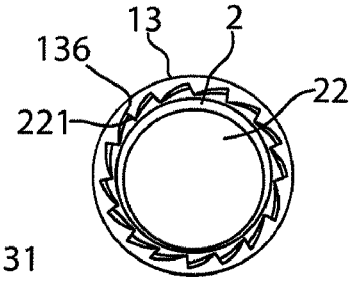
FIG. 5 shows a cross sectional view of the safe device of FIG. 1, illustrating coupling between non-return blocks on a body and non-return blocks on a mouthpiece of the safe device.

With reference to FIG. 4, a rectilinear end 42 of the squeezable container 4 is engaged in the rectilinear groove 33 of the bottom cap 3. Then, the other end 41 of the squeezable container 4 is placed into the compartment 21 of the body 2 until the other end 41 extends beyond the upper opening 22 of the body 2. The tabs 32 of the bottom cap 3 are engaged with the slots 27 of the body 2. Thus, the squeezable container 4 is reliably fixed in the body 2. Next, the protective cover 1 is coupled with the squeezable container 4. Particularly, the inner threading 130 of the mouthpiece 13 is threadedly engaged with outer threading on the squeezable container 4. Furthermore, the piercing portion 134 of the mouthpiece 13 pierces a film 44 of the squeezable container 4 so that the bottom hole 133 of the piercing portion 134 is in communication with an interior 45 of the squeezable container 4. Furthermore, the non-return blocks 136 of the mouthpiece 13 mesh with the non-return blocks 221 surrounding the upper opening 22 of the body 2 such that rotation of the mouthpiece 13 in a direction is allowed and that rotation of the mouthpiece 13 in a reverse direction is not allowed as shown in FIG. 5. When it is required to squeeze liquid adhesive out of the squeezable container 4, the squeezable container 4 is placed upside down such that the end 41 faces downward. The press portions 26 are pressed inward to squeeze the squeezable container 4 so that the fluid in the squeezable container 4 can flow out of the end 41. After the press portions 26 are released, the press portions 26 return to their original, positions not squeezing the squeezable container 4.

Since the non-return blocks 136 of the mouthpiece 13 are stopped by the non-stop blocks 221 of the body 2 when rotated in a reverse direction, the mouthpiece 13 can not be disengaged from the container 4. Since the rotational force applied to the idle cap 11 can only be transmitted to the inner cap 12 when a force greater than a predetermined magnitude is applied to move the idle cap 11 downward to tightly engage with the outer periphery of the inner cap 12 and since such a magnitude of force is beyond a child's ability, opening of the idle cap 11 by the child is avoided. Namely, the child can only rotate the idle cap 11 freely. Injury to the child is avoided.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A safe device for a squeezable container comprising:

a protective cover including an idle cap, an inner cap, and a mouthpiece, with the idle cap including upper and lower openings and a compartment having upper and lower ends respectively in communication with the upper and lower openings of the idle cap, with the inner cap including a compartment with inner threading, with the inner cap including an engaging portion extending upward from a top end thereof and rotatably extending through the upper opening of the idle cap, with the mouthpiece including inner threading, a plurality of first non-return blocks, and a channel, with the mouth piece further including a pointed mouth and a piercing portion having a bottom hole, with the channel including upper and lower ends respectively in communication with the pointed mouth and the bottom hole of the piercing portion, with the mouthpiece further including outer threading threadedly engaged with the inner threading of the inner cap, a body including upper and lower openings and a compartment adapted for receiving a squeezable container, with the compartment of the body including upper and lower ends respectively in communication with the upper and lower openings of the body, with a plurality of non-return blocks being formed on an outer periphery defining the upper opening of the body and meshable with the plurality of non-return blocks of the mouthpiece; and a bottom cap including a plate having a size and an area the same as those of the lower opening of the body, with the plate being engaged in the lower opening of the body.

2. The safe device for a squeezable container as claimed in claim 1, with the body further including two press portions on two opposite sides thereof, with a groove surrounding each of the two press portions, and with each of the two press portions being connected to a connecting section, with each of the two sides of the body further including a slot, and with the plate further including two tabs respectively on two sides thereof and respectively engaged with the slots of the body.

3. The safe device for a squeezable container as claimed in claim 2, with the plate further including a rectilinear groove.

4. A safe device for a squeezable container comprising a protective cover including:

an idle cap including upper and lower openings and a compartment having upper and lower ends respectively in communication with the upper and lower openings of the idle cap;

an inner cap including a compartment with inner threading, with the inner cap including an engaging portion extending upward from a top end thereof and rotatably extending through the upper opening of the idle cap; and a mouthpiece including inner threading and a channel, with the mouth piece further including a pointed mouth and a piercing portion having a bottom hole, with the channel including upper and lower ends respectively in communication with the pointed mouth and the bottom hole of the piercing portion, with the mouthpiece further including outer threading threadedly engaged with the inner threading of the inner cap.

* * * * *